US005566753A

United States Patent [19]

Van Winkle et al.

[11] Patent Number: 5,566,753

[45] Date of Patent: Oct. 22, 1996

[54] STRIPPER/PACKER

[75] Inventors: D. Wayne Van Winkle, Houston; Bobby G. Hurst, Beaumont, both of Tex.

[73] Assignee: Drexel Oil Field Services, Inc., Conroe, Tex.

[21] Appl. No.: 474,393

[22] Filed: Jun. 7, 1995

[51] Int. Cl.[6] ..... E21B 33/02; E21B 33/08

[52] U.S. Cl. ..... 166/84.1; 166/85.3; 251/1.3

[58] Field of Search ..... 166/82.1, 84.1, 166/84.4, 85.3, 88.1; 251/1.3

[56] References Cited

U.S. PATENT DOCUMENTS

| | | | |
|---|---|---|---|
| 2,188,141 | 1/1940 | Abercrombie | 251/1.3 X |
| 2,306,617 | 12/1942 | Dick | 166/82.1 |
| 2,592,197 | 4/1952 | Schweitzer, Jr. | 251/1.3 |
| 3,554,480 | 1/1971 | Rowe | 251/1.3 |
| 4,488,703 | 12/1984 | Jones | 251/1.3 X |
| 4,844,166 | 7/1989 | Going, III et al. | 166/379 |
| 4,923,005 | 5/1990 | Laky et al. | 166/55 |
| 4,938,290 | 7/1990 | Leggett et al. | 166/387 |

OTHER PUBLICATIONS

Texas Oil Tools, 2.50", 10000 psi W. P. Stripper.Packer, Special Otis, Index D.C Unit 1219, Replace 1135, Nov. 1992.

Texas Oil Tools, 2.50 Side Door, Stripper/Packer, 10,000 psi W. P., Unit 1183, Replaces 1143, Jan. 1992.

*Primary Examiner*—David J. Bagnell

*Attorney, Agent, or Firm*—Gunn & Associates, PC

[57] ABSTRACT

A stripper/packer for use in a stack at a well head provides horizontal actuation and side access. This configuration enables maintenance of the packer in place. It also provides for the retraction of the packer to a diameter greater than the inside diameter of the packer to permit the withdrawal of coiled tubing with accessories attached. A hydraulically actuated rod has a pusher plate attached at one end with bushings and bushing carriers attached thereto. The bushings and bushing carriers hold a packer element in abutting relation to an energizer which evenly distributes pressure from the pusher plate to the packer element. The bushings and bushing carriers also hold the packer element so that, upon retraction of the rod, the entire assembly is withdrawn from the bore of the stripper/packer.

8 Claims, 5 Drawing Sheets

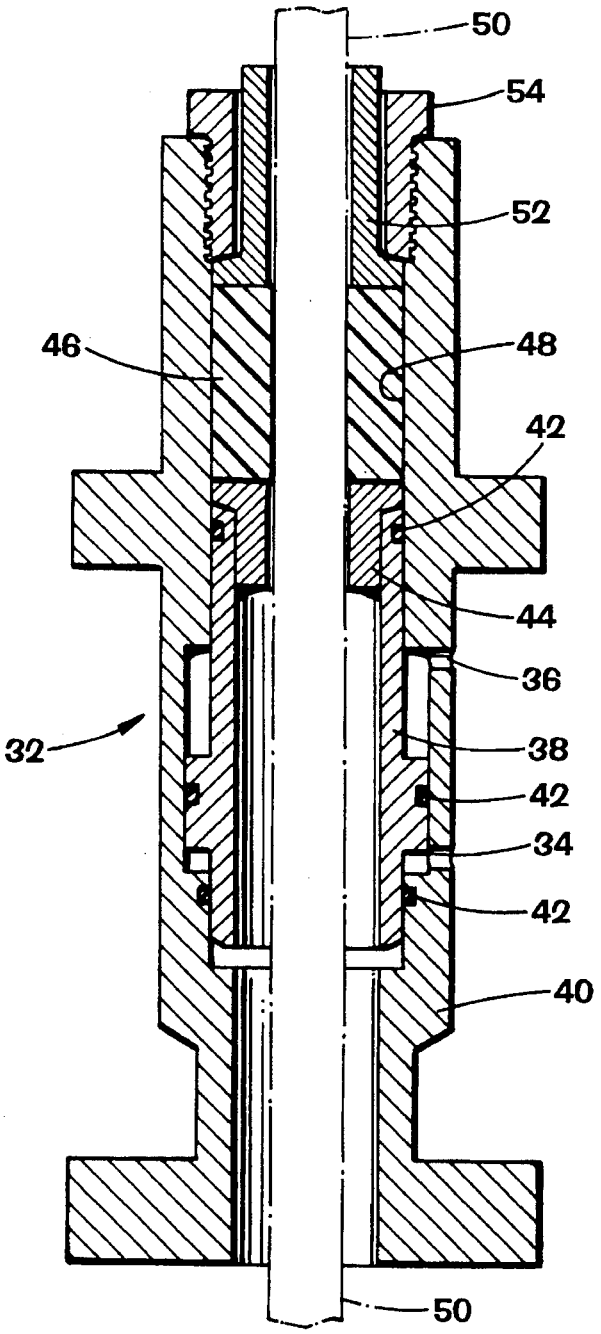
FIG. 2
( PRIOR ART )
FIG. 3
( PRIOR ART )
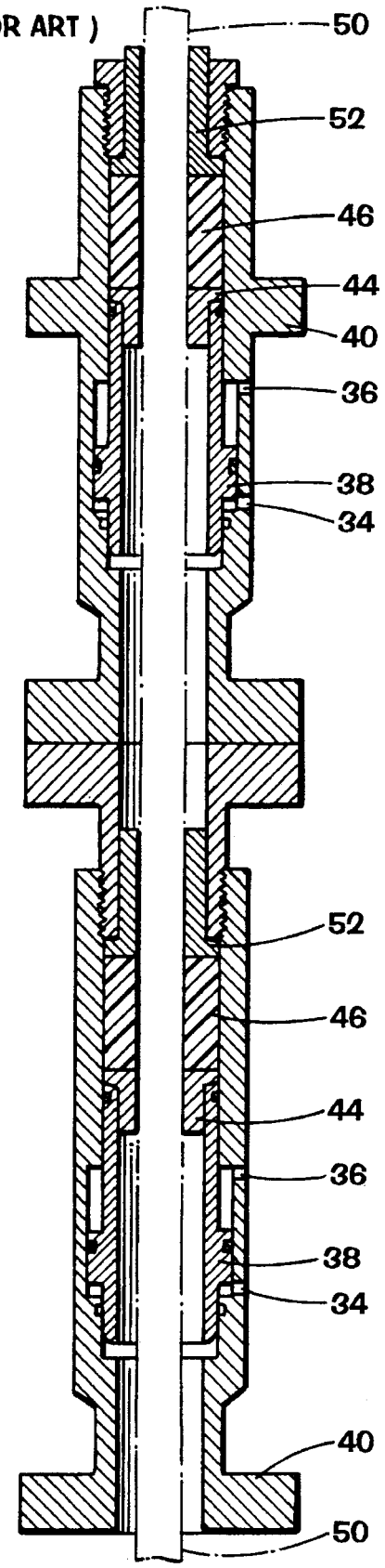

STRIPPER/PACKER

FIELD OF THE INVENTION

The present invention relates generally to the field of oil field equipment and, more particularly, to a stripper/packer that may be installed in a stack at a well head.

BACKGROUND OF THE INVENTION

Packers have been in use in oil and gas wells for many years. A packer is generally used to seal off down hole pressure from lower well pressures above the packer. Thus, the packer may be used at a downhole location to, for example, segregate various formation strata from other regions along the well bore. A packer may also be used in the stack at the well head to provide a seal for down hole pressures so that various operations may be performed safely above the well.

A packer commonly comprises a packer element made of a polymeric material that is somehow deformed to seal between a tubular member extending through the packer and the body of the packer. The packer also may include bushings above and below the packer element to prevent extrusion of the packer element. The bushings above and below the packer element also center the tubular member and provide long wear life for the packer element.

Although the packer element is made of a flexible polymeric material, movement of the tubing through the packer abrades away the inner surface of the packer requiring eventual replacement. Sufficient permanent deformation of the packer element will cause the packer to leak by and the packer element must therefor be replaced. Replacement of the packer elements has been shown to be an expensive and often dangerous operation since the packer must be uncoupled from the stack at the well head.

The use of two stripper/packers in tandem in the stack at the well head has become routine practice in the art. The use of tandem packers minimizes down time and offers greater safety and flexibility to operations. The upper packer is mounted below the injector head in the usual manner. The lower packer is then mounted directly beneath the upper packer. In this configuration, the lower packer is generally energized to seal the wellbore around the tubing when the upper packer becomes worn. Once the lower packer is energized, the tubing operations continue as normal until it is convenient to replace both upper and lower packer elements.

Unfortunately, with two stripper/packers in tandem, the packer replacement evolution becomes even more difficult, requiring a great deal of time and involving even greater hazards to the maintenance personnel.

Further, the configuration of known stripper/packers includes packer elements that remain in the bore of the stripper/packer, even when the packer is in the release position. This may prove particularly disadvantageous when various accessories are attached to the tubular member, such as coiled tubing, and the tubing; must be withdrawn from the hole. When such an accessory reaches the packer element, the packer usually must be disassembled to withdraw all of the tubular member from the hole.

Thus, there remains a need for a stripper/packer in which the packer element may be replaced without the need to remove the packer from the stack. There also remains a need for a stripper/packer having a packer element and such bushings as may be required, that can be withdrawn from the bore of the stripper/packer without disassembling the packer or removing the packer from the stack.

Such a stripper/packer should be easily adaptable to stacks currently in use, be simple in construction to minimize the cost of construction and enhance the ease of maintenance. Finally, the packer must securely pack off down hole pressure and work at least as effectively as known packers.

SUMMARY OF THE INVENTION

The present invention solves these and other drawbacks of the prior art by providing a side access stripper/packer. The packer of the present invention is particularly adapted for use with coiled tubing, but is equally applicable to types of piping through a casing down hole. The packer may be installed in single or tandem configurations.

The stripper/packer may be installed as the top component of the pressure containing stack of equipment located directly below an injector head. This invention ensures safety and saves time when running production or exploration tubing, connectors, or other components having a larger outside diameter than the tubing on which it is connected, while the tubing is run in or out of the borehole. This feature of the present invention is provided by the provision of a retraction position of the packer and bushing, to equal or exceed the inside diameter of the stripper/packer. The packer and guide bushings are retracted to a full open bore position without breaking any seals to the environment.

The stripper/packer of the present invention includes horizontal actuators that result in a substantial reduction in overall height compared to packers known in the art.

The stripper/packer also permits replacement of the packer and bushings in the open space below the injector head. This makes for easier packer changeout, even with tubing in the well.

In the packer of the present invention, hydraulic system pressure is used to energize opposing rams that seal around the tubing, particularly coiled tubing. Each ram has a double acting hydraulic cylinder requiring separate hydraulic hoses to extend and retract.

These and other features of the present invention will be immediately apparent to those of skill in the art from a review of the following detailed description along with the accompanying drawings.

BRIEF DESCRIPTION OF THE DRAWINGS

FIG. 2 is a side section view of a prior art packer.

FIG. 3 is a side section view of a pair of prior art packers, like the packer of FIG. 2, stacked in tandem.

DETAILED DESCRIPTION OF A PREFERRED EMBODIMENT

Figure 1:
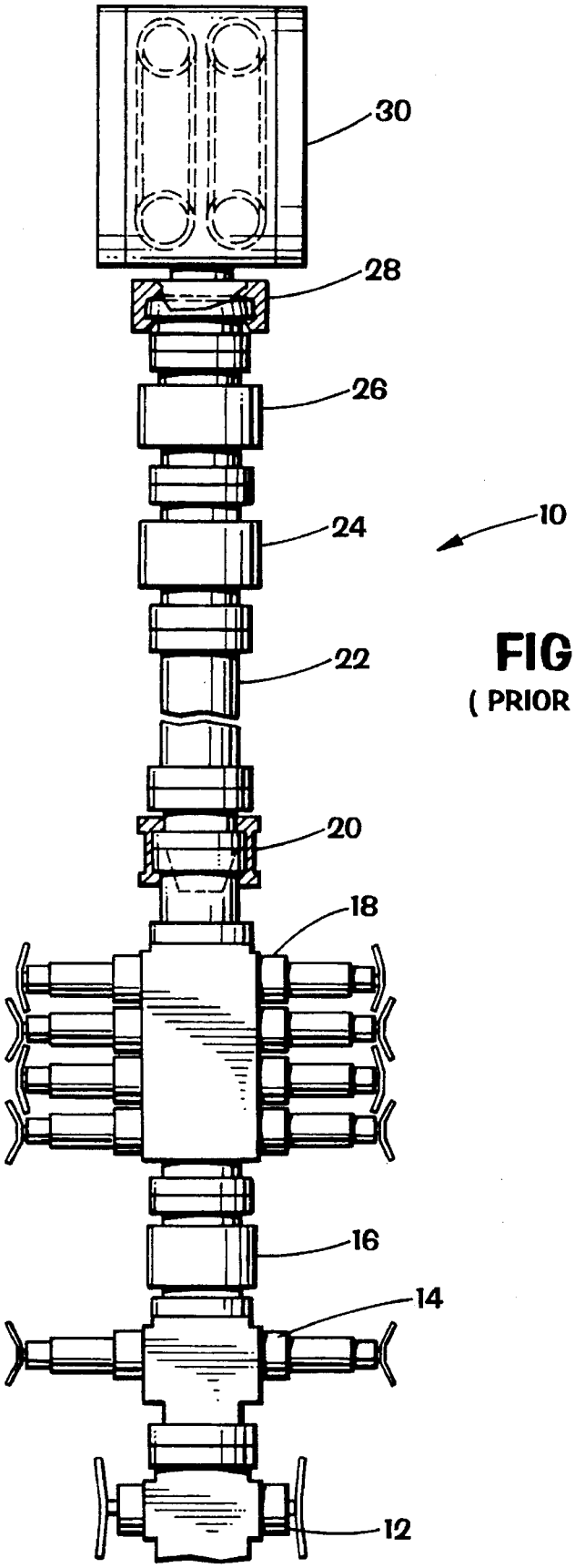
FIG. 1 ( PRIOR ART )
FIG. 1 is a side silhouette view of a prior art stack of elements that may included at a well head.

FIG. 1 depicts a typical stack 10 that is commonly used on a well head 12. Above the well head may be included, in bottom-to-top order, a blowout preventer 14, a flow Tee 16, a standard quad BOP 18, a HydraConn connector 20, a lubricator riser 22, a pair of striper/packers 24 and 26, an injector connector 28, and an injector 30 for the insertion of coiled tubing. Those of skill in the art will recognize that this is only intended to represent a typical stack, which is designed or modified to meet a specific application. Further, the various components selected to form the stack are typically joined together, such as by flanges for example, in a manner known in the art.

FIG. 2 depicts a conventional packer 32 for use at a well head. The packer is operated by applying hydraulic pressure of a pack-off port 34 and the packer is released by pressurizing a release port 36. Releasing the packer in this manner only relaxes the packoff force on the packer, and does not result in withdrawing the packer element to an inside diameter greater than the inside diameter of the wear bushings. Applying hydraulic pressure to either the pack-off port 34 of the release port 36 operates an annular piston 38 within the packer body 40. The annular piston 38 is sealed within the packer body 40 by seals 42 in a manner well known in the art.

Pressurization of the pack-off port 34 moves the piston 38 up (as seen in FIG. 2), abutting a (generally brass) wear bushing 44. As the wear bushing 44 is pressed upward, it squeezes a packer element 46 so that it is compressed against the interior surface 48 of the packer body 40 and against a tubular member 50, which extends through the packer 32. The packer element 46 is held in place at its upper end by a (generally brass) bushing 52 which prevents extrusion of the packer element out of the packer as tubing is stripped out of the packer or from the force of well pressure, which may be 10,000 psi or greater. The entire assembly is held together by a gland nut 54.

FIG. 3 depicts a typical tandem arrangement of a pair of packers, as previously described. The constituent elements remain the same as those described with regard to FIG. 2, and are numbered in FIG. 3 accordingly. It should be noted that the upper packer may be used until it becomes worn and then the lower packer may be energized. In this configuration, either of the packers seals the bore hole against the entire down hole pressure.

As shown in FIGS. 2 and 3, in order to replace a packer element 46, the gland nut 54 is removed from its threaded connection, and then the bushing 52 is removed. The packer element 46 is then grasped and removed, and a new packer element 46 is inserted. As shown in FIG. 3, is the packer element 46 in the lower packer is to be replaced, the two packers must be separated for access to the lower elements, requiring a major maintenance evolution.

Figure 4:
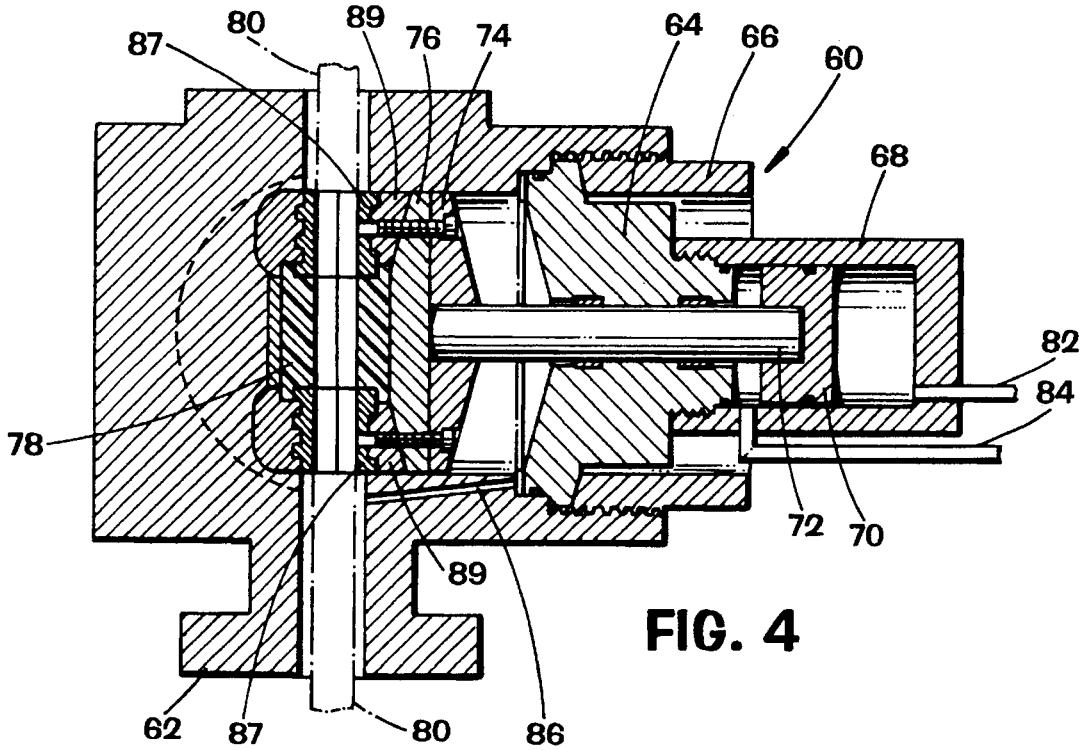
FIG. 4 is a side section view of the stripper/packer of the present invention.

FIG. 4 depicts the horizontally actuated stripper/packer 60 of the present invention. The packer 60 comprises a body 62 which receives a guide 64, held in place with a gland nut 66. Mounted on the guide 64 is a cylinder 68 with an enclosed piston 70. The piston 70 is coupled to a piston rod 72 which coupled at its other end to a pusher plate 74. The pusher plate 74 abuts against an energizer 76, which is preferably made of a soft polymeric material. The energizer evenly distributes force to a set of bushing carriers 89 (see also FIG. 7), moving the bushing carrier 89 and a set of bushings 87 to close proximity to the tubing in order to prevent extrusion of the packer at higher well pressures. Additional force acts against a packer element 78 to seal around the entire circumference of a tubular member 80.

Figure 5:
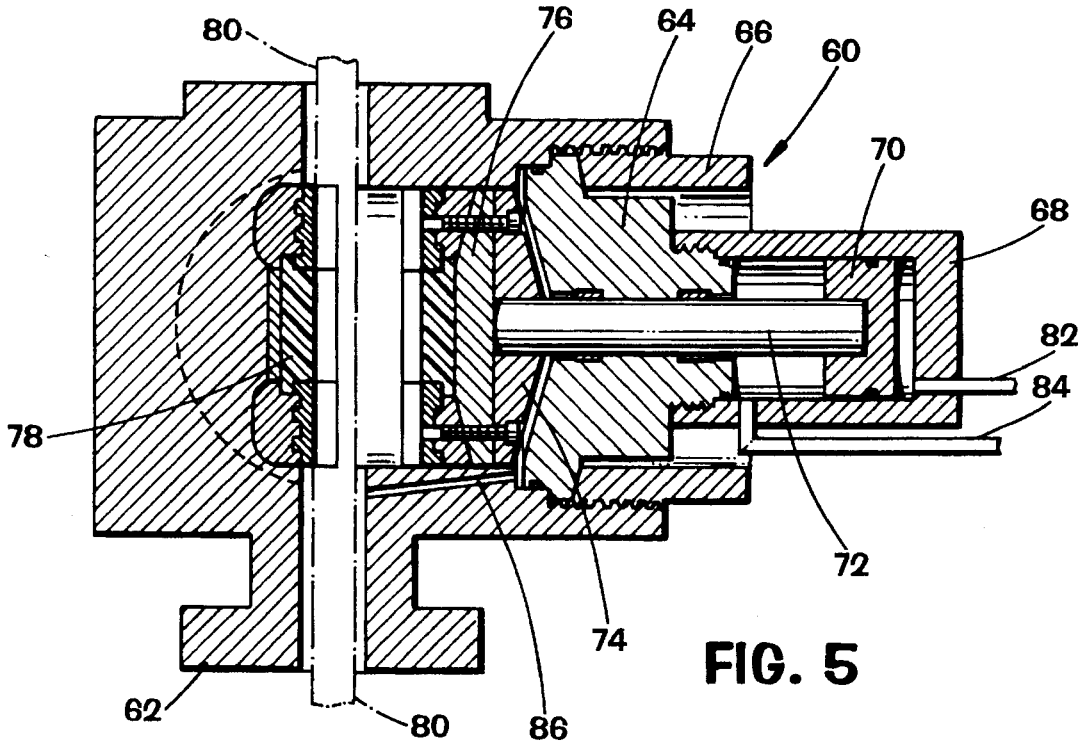
FIG. 5 is a side section view of the stripper/packer of the present invention depicted in a withdrawn state.

The packer 60 of the present invention is energized through a packoff port 82 and released by pressurizing an open or release port 84. FIG. 4 depicts the packer 60 in the set or packed off condition, while FIG. 5 shows the packer in the released (and fully retracted) position. As the packer is moved between the packoff and released conditions, a bypass port 86 permits pressure equalization.

FIG. 5 depicts another feature of the present invention. With the release port pressurized, the pusher plate 74 is retracted, withdrawing the energizer 76 and the packer element 78, along with the upper and lower bushing carriers 89 and bushings 87. This retracts the packer components to permit full bore size access for the withdrawal of tubing mounted components, a feature that is not available in the packer shown in FIGS. 2 and 3.

Figure 6:
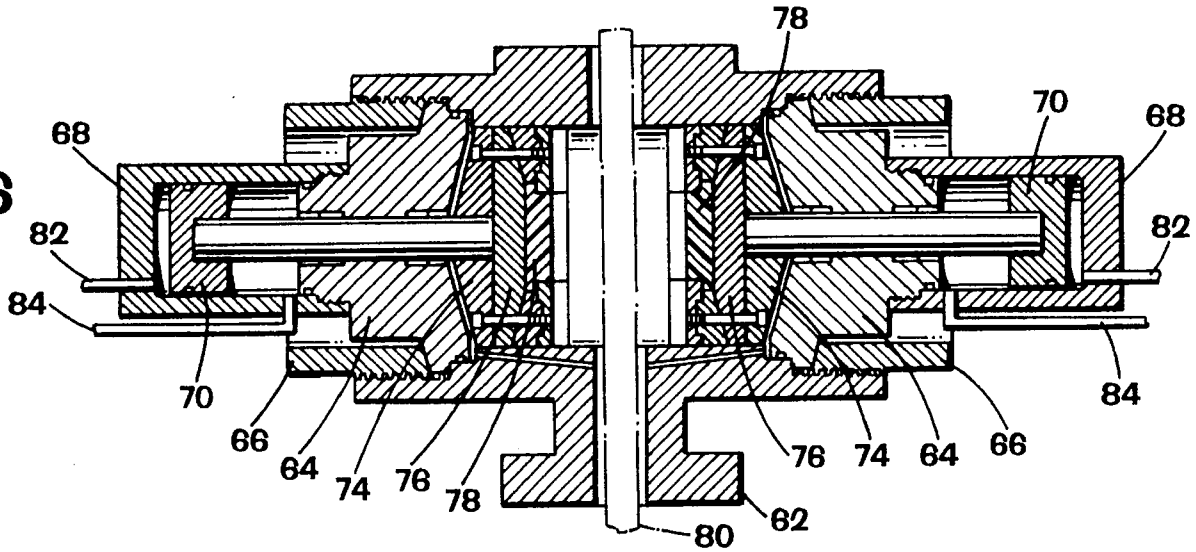
FIG. 6 is a full side section view of the stripper/packer depicting opposed packer elements and actuators.

It should also be understood that FIGS. 4 and 5 depict the active components of the one-quarter section, and that the complementary components opposite the packer actuation elements are also included on the left-hand side (see FIGS. 6 and 8) to provide a completely free access for the withdrawal of tubing mounted components.

Figure 7:
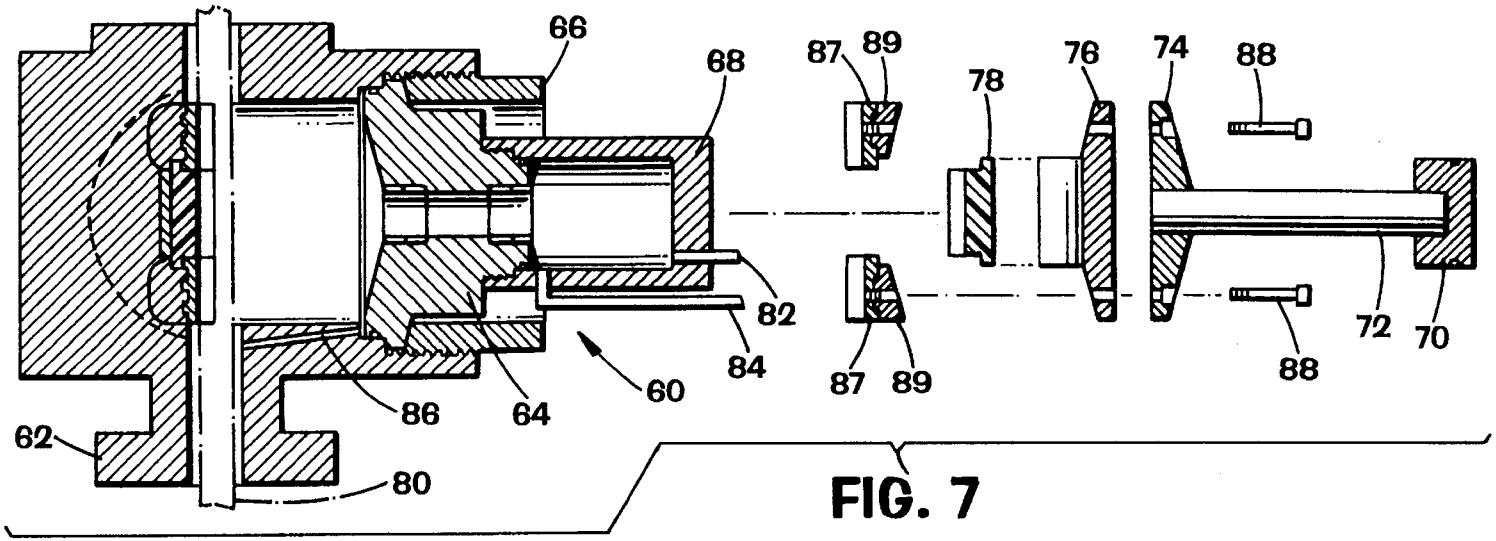
FIG. 7 is an exploded section view of the stripper/packer to show the various internal components of the apparatus.

For a greater understanding of the relationships between the various components, FIG. 7 depicts a partially exploded view of the packer 60 of the present invention. For clarity of illustration in FIG. 7, the moving parts have been removed from the body 62 of the packer, the guide 64, and the cylinder 68. The moving parts include the piston 70, coupled to the piston rod 72, which is joined to the pusher plate 74. The pusher plate abuts against the energizer 76 which distributes the transmitted pressure evenly to the packer element 78, the bushings 87, and the bushing carriers 89. The pusher plate 74, the energizer 76, the bushings 87, and the bushing carriers 89 are preferably all coupled together by a set of bolts 88 to complete the subassembly.

Figure 8:
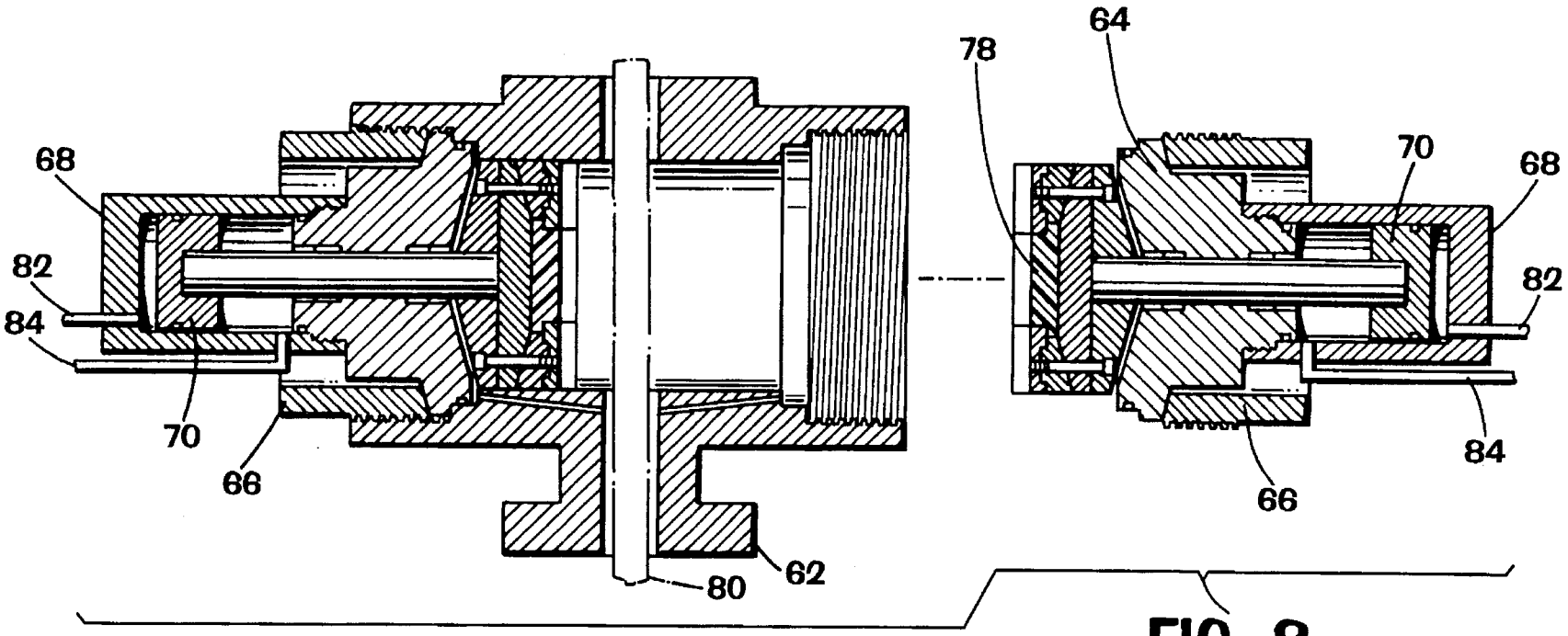
FIG. 8 is a full side section view of the stripper/packer opened to permit replacement of the packer elements in accordance with a feature of the present invention.

Finally, FIG. 8 depicts the packer of the present invention in a maintenance condition. In order to remove the packer assembly, the gland nut 66 is removed and the packer element and all of the associated actuation elements can be removed from the packer body 62. In this way, the packer element 78 can be easily replaced without removing the stripper/packer from the stack.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

We claim:

1. A stripper/packer comprising:

a. a housing with a bore extending through the housing;

b. a chamber extending laterally of the bore in the housing and communicating with the bore;

c. a packer element within the chamber; and d. a horizontally oriented actuator in contact with the packer element to compress the packer element, the actuator comprising:

i. a horizontally oriented rod;

ii. a prime mover coupled to a first end of the rod; and iii. a pressure transmitter on a second end of the rod, the pressure transmitter in abutting contact with the packer element, the pressure transmitter comprising: a pusher plate coupled to the second end of the rod; and a polymeric energizer between the pusher plate and the packer element.

2. The stripper/packer of claim 1 further comprising a bushing and a bushing carrier coupled to the pusher plate to hold the packer element against the energizer.

3. The stripper/packer of claim 1 wherein prime mover is hydraulically driven.

4. The stripper/packer of claim 1 wherein actuation of the stripper/packer extends the packer element within the bore and release of the stripper/packer withdraws the packer element from the bore.

5. A stripper/packer comprising:

a. a housing with a bore extending through the housing for receiving coiled tubing through the bore;

b. a pair of horizontally oriented opposed chambers extending laterally of the bore in the housing and communicating with the bore;

c. a packer element comprising two hemicylindrical portions, one of said hemicylindrical portions in each of said chambers; and d. a horizontally oriented actuator in each of the chambers, the actuator in contact with the packer element to compress the packer element, the actuator comprising:

i. a horizontally oriented rod;

ii. a prime mover coupled to a first end of the rod; and iii. a pressure transmitter on a second end of the rod, the pressure transmitter in abutting contact with the packer element, the pressure transmitter comprising:

i. a pusher plate coupled to the second end of the rod; and ii. a polymeric energizer between the pusher plate and the packer element.

6. The stripper/packer of claim 5 further comprising a bushing and a bushing carrier coupled to the pusher plate to hold the packer element against the energizer.

7. The stripper/packer of claim 5 wherein prime mover is hydraulically driven.

8. The stripper/packer of claim 5 wherein actuation of the stripper/packer extends the packer element within the bore and release of the stripper/packer withdraws the packer element from the bore.

* * * * *